US005104697A

United States Patent [19]

Heikkinen et al.

[11] Patent Number: 5,104,697

[45] Date of Patent: Apr. 14, 1992

[54] INVERTED BLADE METERING UNIT AND METHOD FOR BLADE-COATING A MATERIAL WEB

[75] Inventors: Jukka Heikkinen, Kerava; Juhani Eskelinen, Helsinki; Aaron Mannio; Pekka Koivukunnas, both of Järvenpää, all of Finland

[73] Assignee: Valmet Paper Machinery Inc., Helsinki, Finland

[21] Appl. No.: 461,833

[22] Filed: Jan. 8, 1990

[30] Foreign Application Priority Data

Jan. 17, 1989 [FI] Finland ..... 890249

[51] Int. Cl.[5] ..... B05D 3/12

[52] U.S. Cl. ..... 427/356; 118/410

[58] Field of Search ..... 118/410, 413; 427/356

[56] References Cited

U.S. PATENT DOCUMENTS

| | | | |
|---|---|---|---|
| 4,250,211 | 2/1981 | Damrau et al. | 427/356 |
| 4,452,833 | 6/1984 | Holt | 118/410 X |
| 4,791,879 | 12/1988 | Eklund et al. | 118/410 X |
| 4,869,933 | 9/1989 | Sollinger et al. | 427/356 |

FOREIGN PATENT DOCUMENTS 861241 3/1986 Finland .

*Primary Examiner*—Shrive Beck
*Assistant Examiner*—Alain Bashore

[57] ABSTRACT

The invention concerns a blade coater and a method for coating a web backed by a rotatable backing roll. The blade coater unit includes a support structure, a feeder mounted to the support structure and capable of feeding the coating mix onto the web when brought close to the web in running conditions, and a smoothing device arranged to the immediate vicinity of the web for the application of the fed coating mix. The blade coater unit is essentially placed below the backing roll, the smoothing device is a flexible blade having a tip inclination angle $\alpha$ less than 20°, and the feeder has a narrow exit opening arranged to the stem of the flexible blade without any essential steps in order to facilitate a fast, laminar flow of the coating mix. The approach in accordance with the invention achieves a coat of high quality.

11 Claims, 4 Drawing Sheets

INVERTED BLADE METERING UNIT AND METHOD FOR BLADE-COATING A MATERIAL WEB

BACKGROUND OF THE INVENTION

1. Field of the Invention

The present invention relates to an inverted blade metering unit for coating a web backed by a rotatable backing roll with a coating mix.

The invention also concerns a method for metering coating mix onto a material web.

2. Description of Related Art

Disclosed in FI patent application 861241 is a method and apparatus for coating a web. The method according to the publication uses a flexible blade for the preapplication of the mix, while the final doctoring is performed by a scraping doctor blade. The coater apparatus is placed to the side of the backing roll allowing the coating mix to meet the web over a great length of the web. Removal of entrained air from the coating mix is awkward in the disclosed method, and the integrated construction of the doctor blade with the coater structure complicates service operations. Further, coating mix behavior in the disclosed method is sensitive to disturbances in the application zone such as uneven distribution of mix quantity. Typical consequences therefrom include striping of web coating in the machine direction of the web.

OBJECTS AND SUMMARY OF THE INVENTION

The aims of the present invention include, for instance, to overcome the drawbacks associated with the technology described above and to achieve an entirely novel blade metering unit and method for metering the coating mix.

The invention is based on mounting the blade metering unit with a predoctoring blade under the backing roll and feeding the coating mix in a laminar flow at a high velocity to the stem part of the predoctoring blade. In addition, a maximal distance between the predoctoring blade and actual doctor blade performing the possible final doctoring is used. The purpose of the predoctoring blade is to homogenize the flow of the coating mix particularly in the cross direction of the coater unit.

More specifically, the brush coater in accordance with the invention is characterized by an inverted blade metering unit for coating a web backed by a rotatable backing roll with a coating mix, comprising:

a support structure;

feed means, attached to the support structure, for feeding the coating mix onto the web when brought close to the web in running conditions; and a predoctoring blade positioned blade positioned immediately adjacent the web for application of the fed coating mix, wherein the coater unit is essentially placed below the backing roll, the predoctoring blade is a flexible blade with an inclination angle of the tip less than 20° relative to the web, and the feed means has a narrow exit opening arranged at a stem of the flexible blade in order to facilitate a fast, laminar flow of the coating mix in advance of said predoctoring blade.

Furthermore, the metering method of coating mix in accordance with the invention is characterized by a method for coating a web with a coating mix, comprising the steps of:

applying metered coating mix onto a moving web; and smoothing the applied coating mix evenly onto the web with a flexible predoctoring blade, wherein the coating mix is applied to the web by the predoctoring blade in the form of a high-velocity laminar flow in advance of said predoctoring blade.

The invention provides outstanding benefits. These include:

longitudinal striping characteristic to short-dwell coating can be avoided, penetration of coating mix into web (e.g., base stock) becomes controllable, splashing is reduced, in comparison to a metering bar coater, smaller amount of mix need be fed into the coater, coating mixes with higher solids and viscosities can be used, mix flow to the doctor blade is controllable, cross-direction profile control of coat application is possible by altering the amount of applied mix in cross-direction, coating can be started from application of coating mix, higher coat weights and operational speeds are possible, linear blade pressure against web is lower than in conventional single-blade coating, stress on web (base paper) is smaller, and cheaper web material (base stock) can be used, blade wear is reduced, regulation of applied amount of coating mix is easy, and in favorable cases the coating unit can be run without the actual doctor blade.

The invention is next examined in detail with the help of exemplifying embodiments illustrated in the attached drawings.

DETAILED DESCRIPTION OF PREFERRED EMBODIMENTS

Figure 1:
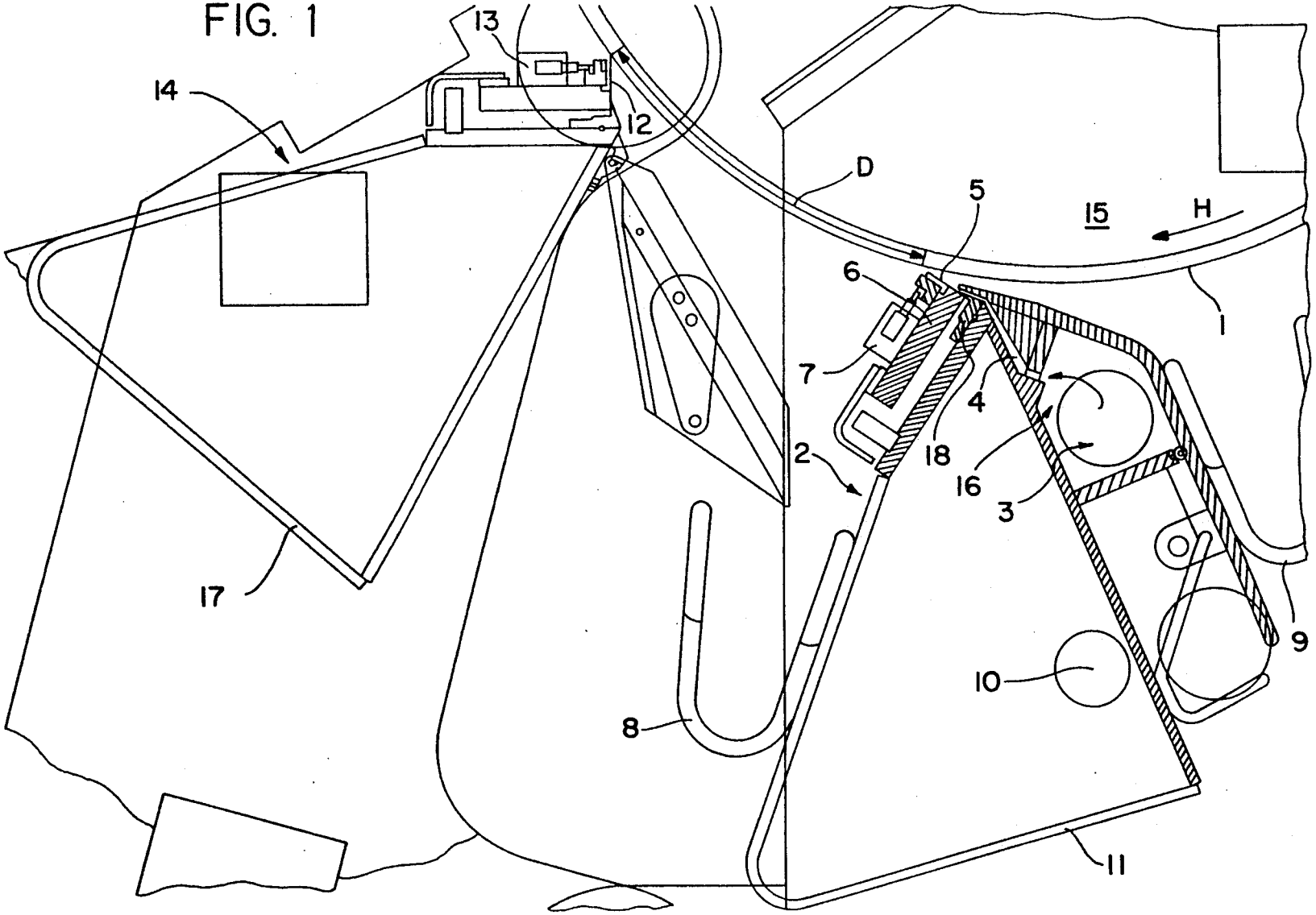
FIG. 1 shows in a sectional side view an inverted blade metering unit in accordance with the invention in running condition.

The inverted blade metering unit illustrated in FIG. 1 comprises a backing roll 15, whose rotational direction is marked by arrow H and whose surface is conformally covered by the paper web 1 to be coated. Extending over the cross-directional width of web 8, under the backing roll 15 is paced a blade metering unit 2, whose frame is formed by a support beam 11 with an approximately triangular cross section. The support beam 11 is pivotally mounted at a pivot point 10 to the support structure to be illustrated in the subsequent figures. The coating mix is fed along a cross-directionally aligned feed channel 3, which is mounted onto the support beam 11 to the entrance side of the web 1, into a cavity-resembling space 16, wherefrom the mix is propelled under pressure into a narrow feed channel 4. As evident from FIG. 1, the feed channel 4 sectioned in the plane of the flow vector of the coating mix has a shape approximately similar to a letter S. The feed channel 4 exits to the stem part of a predoctoring blade 5. The feed channel 4 is extremely narrow and smooth in comparison to conventional feed channels; the exit opening of the feed channel 4 in particular has typically a height of only 3 . . . 5 mm. The predoctoring blade 5 is fixed at its stem between blade holders 6 and 18. The blade 5 leans flexibly on the web 1 at a small angle $\alpha$. The angle $\alpha$ is typically less than 20°. The blade holders 6 and 18 are implemented so at to avoid forming any significant step between the exit opening of the feed channel 4 and the stem of the blade 5. In particular, the blade holder 18 facing the blade at the side of the feed channel side 4 has a wedge-shaped cross section tapering toward the tip of the blade 5. The reason for fixing the blade in this manner is to maintain a laminar flow pattern of the mix exiting from the feed channel 4 up to the tip of the blade 5 leaning against the web 1. The linear loading of the predoctoring blade 5 can be regulated by a load control device 7. The load control device 7 is divided in the cross direction of the web 1 into independent control sections, whereby the loading of the blade 5 can be varied in the cross direction of the web 1 thus allowing for a control means of the applied coating mix quantity in order to obtain a desired coat weight profile in the cross direction of the web. Due to the high feed velocity exceeding 1 m/s, the excess mix will also spread toward the entry direction of the web 1. This excess mix is collected to a first mix collecting trough 9. Furthermore, the excess coating mix flowing over the blade is collected to a second mix collecting trough 8.

When required, the final doctoring is performed using a doctoring unit 14, which comprises an actual doctor blade 12 attached to a second frame beam 17. The loading of the doctor blade 12 can be regulated by a load control device 13. As is evident from FIG. 1, distance D from the tip of the predoctoring blade 5 of the inverted blade metering unit 2 to the tip of the actual doctor blade 12 is rather large in the implementation according to the invention, typically being in the order 0.5 . . . 0.8 m. At typical web speeds used in practice, this distance corresponds to a duration of travel of approx. 30 . . . 40 $\mu$s.

Figure 2:
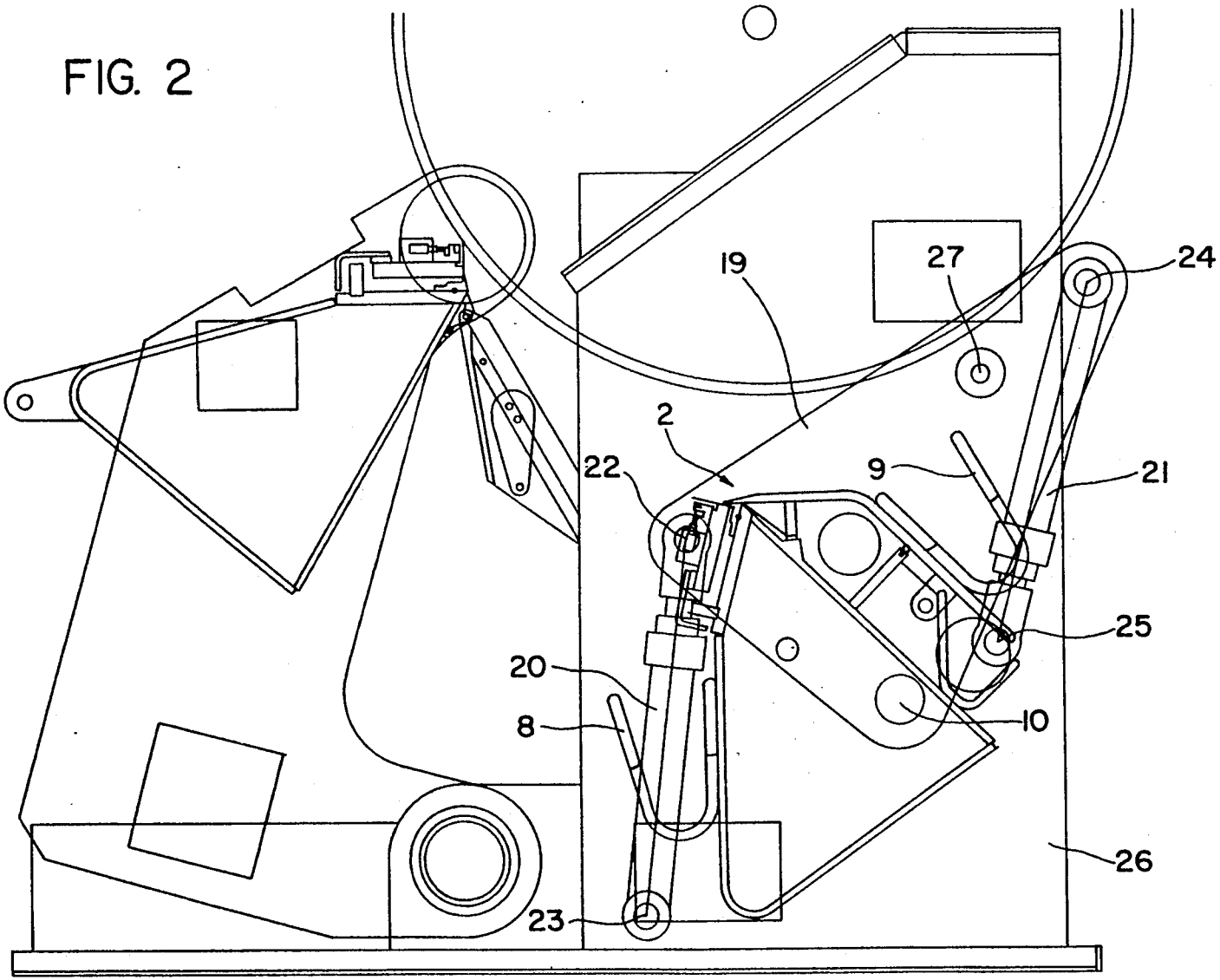
FIG. 2 shows the inverted blade metering unit illustrated in FIG. 1 moved to its lower position.

In accordance with FIG. 2, the inverted blade metering unit 2 is pivotally mounted at point 10 to a triangular support structure 19, which further is pivotally mounted to a frame 26 of the coater unit at a pivot point 27. The inverted blade metering unit is moved by two actuator elements 20 and 21, whose length is controllable. The first actuator element 20 is pivotally mounted at its lower end 23 to the frame 26 of the coater unit and at its upper end, to the leftmost corner 22 of the triangular support structure 19. The second actuator element 21 is pivotally mounted at its upper end 24 to the upper corner of the support structure 19 and at its lower end 25 to the inverted blade metering unit 2, to the vicinity of the first mix collecting trough 9. In the situation illustrated in FIG. 2, both the first actuator element 20 and the second actuator element 21 are in their contracted positions.

Figure 3:
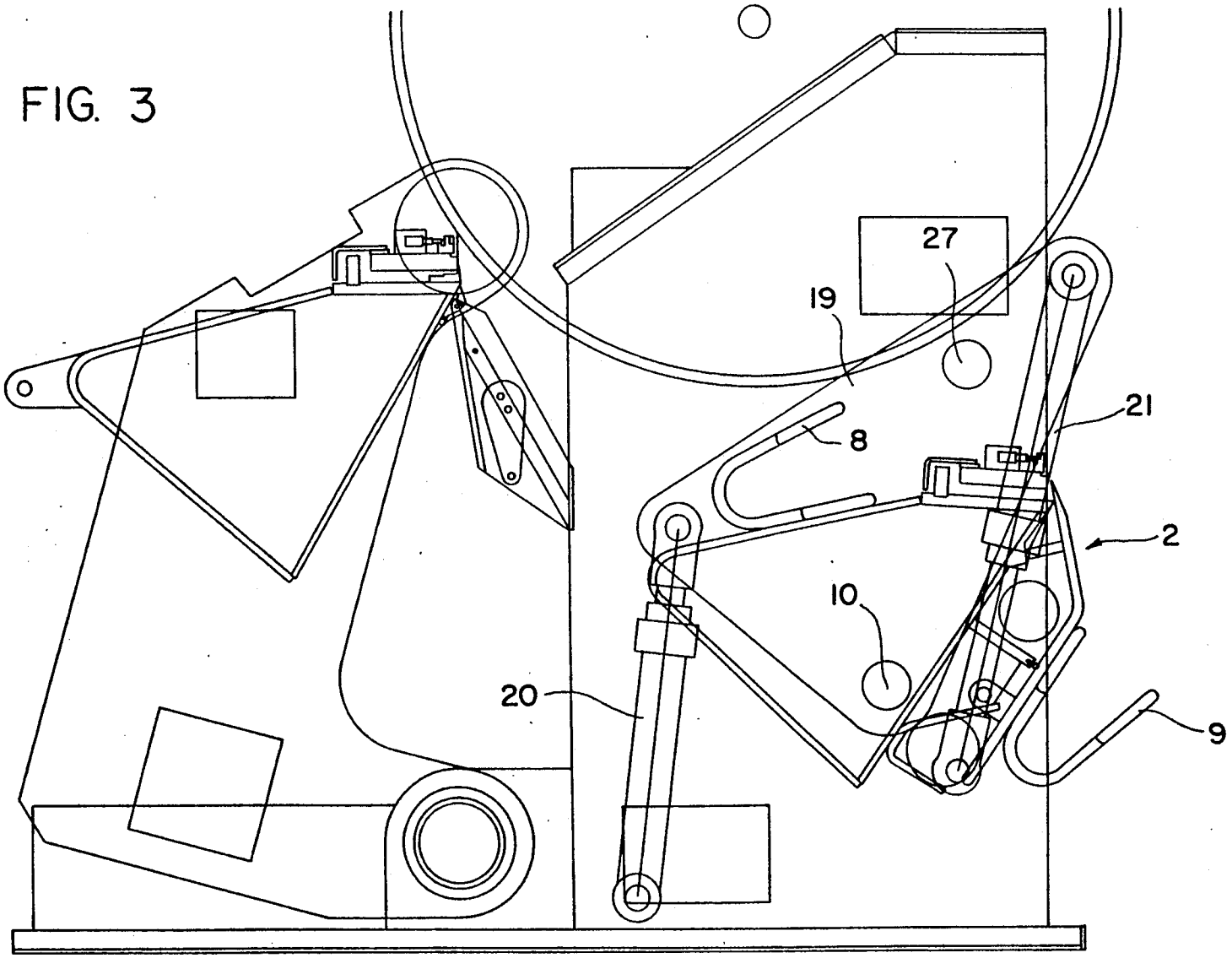
FIG. 3 shows the inverted blade metering unit illustrated in FIG. 1 moved to its backward inclined position.

Shown in FIG. 3 is the second actuator element 21 in its extended position necessary for bringing the inverted blade metering unit 2 to a servicing position, in which the mix collecting troughs 8 and 9 can be cleaned.

Figure 4:
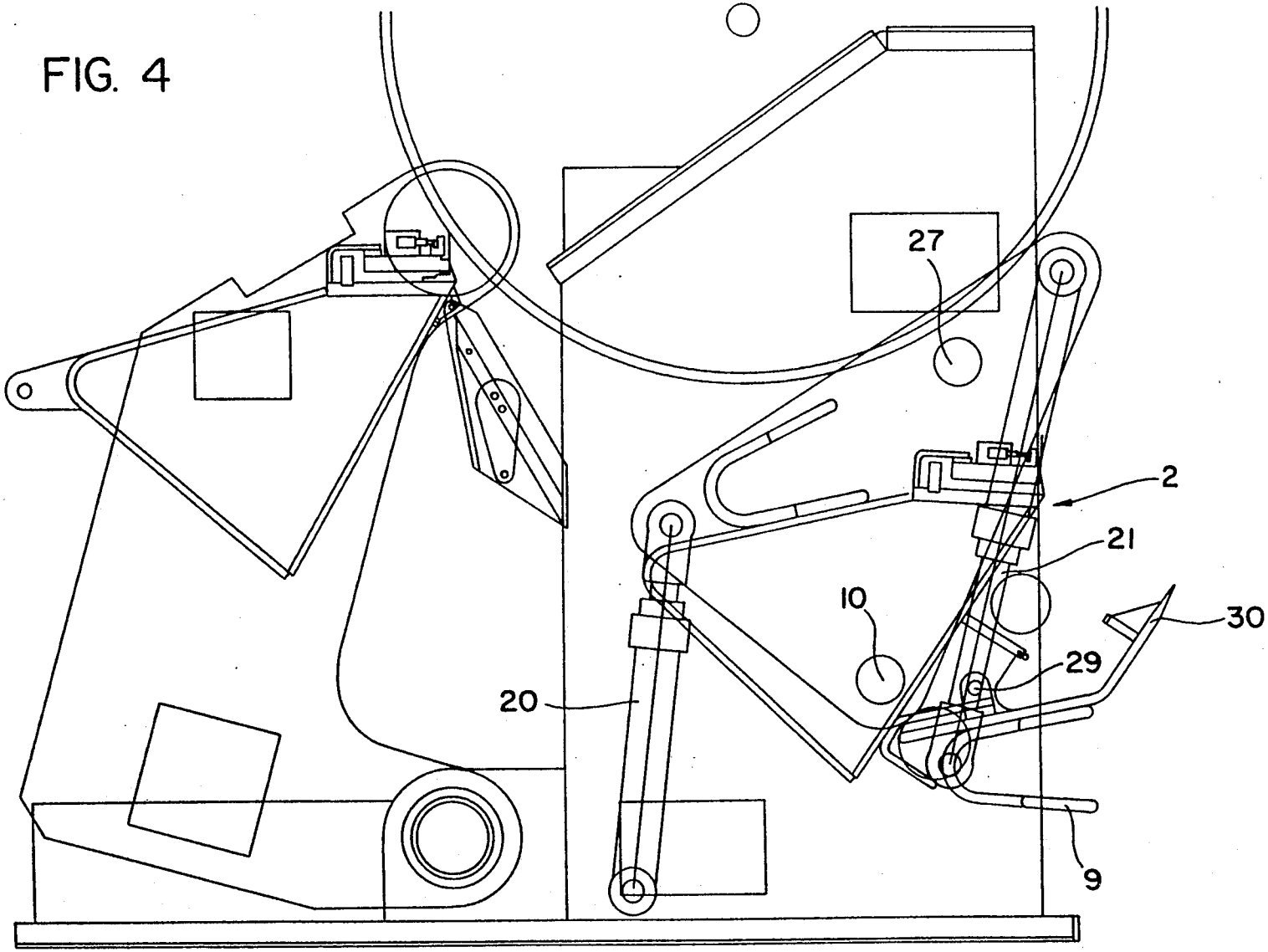
FIG. 4 shows the inverted blade metering unit illustrated in FIG. 1 moved to its backward inclined position with the chamber of the blade metering unit opened.

Shown in FIG. 4 is a cover 30 of the inverted blade metering unit 2 open for servicing operations. The cover 30 is provided with hinges attached to the inverted blade metering unit close to the mix collecting trough 9.

The tip inclination angle $\alpha$ of the blade 5 may be adjusted even smaller than 20°. Optimum adjustments of tip inclination angle and applied amount of coating mix can in favorable cases avoid the use of the actual doctor blade 12.

The use of a conventional short-dwell coater following the inverted blade metering unit 2 is also possible.

What is claimed is:

1. An inverted blade metering unit for coating a web backed by a rotatable backing roll with a coating mix from a coater unit, comprising:

a support structure;

feed means, attached to the support structure, for feeding the coating mix onto the web when brought close to the web in running conditions; and a predoctoring blade positioned immediately adjacent the web for application of fed coating mix, wherein the coater unit is essentially placed below the backing roll, the predoctoring blade is a flexible blade with an inclination angle of the tip less than 20° relative to the web, and the feed means has a narrow, smooth channel with a narrow exit opening arranged at a stem of the flexible blade in order to facilitate a fast, laminar flow of the coating mix to said predoctoring blade and thereby avoid turbulence of the coating mix.

2. The inverted blade metering unit in accordance with claim 1, wherein a height of the narrow exit opening of said feed means is not greater than 5 mm.

3. The inverted blade metering unit in accordance with claim 1 or 2, wherein the flexible blade is provided with a loading control element, with which loading of the blade can be adjusted in a cross direction of the web for the control of an applied quantity of coating mix.

4. The inverted blade metering unit in accordance with claim 1 or 2 wherein the exit opening of said feed means comprises a blade holder having a wedge shaped cross section.

5. The inverted blade metering unit in accordance with claims 1 or 2 wherein the narrow, smooth channel of said feed means has a sectional shape approximately similar to a letter S.

6. The inverted blade metering unit in accordance with claims 1 or 2 wherein the support structure is pivotally mounted by a first pivot point to a second support structure further pivotally mounted by a second pivot point to a frame of the unit and both support structures are pivotally rotatable by an actuator means about their pivot points for moving the inverted blade metering unit from a running position to a service position, and vice versa.

7. A method for coating a web with a coating mix, comprises the steps of:

applying metered coating mix onto a moving web; and smoothing the applied coating mix evenly onto the web with a flexible predoctoring blade, wherein the coating mix is applied to the web by the predoctoring blade in the form of a high-velocity laminar flow in advance of said predoctoring blade.

8. The method in accordance with claim 7, wherein the coating mix is fed to a stem part of the flexible blade via an exit channel having a narrow opening.

9. The method in accordance with claim 7 or 8, wherein the loading of the flexible blade acting as the smoothing means is controlled in a cross direction of the web in order to control the cross-directional profile of the applied coat weight.

10. The inverted blade metering unit in accordance with claim 1, wherein a feed velocity of the laminar flow is at least 1 m/sec.

11. The method in accordance with claim 7, wherein a feed velocity of the laminar flow is at least 1 m/sec.

* * * * *